United States Patent [19]

Schick et al.

[11] 4,304,678

[45] Dec. 8, 1981

[54] LUBRICANT COMPOSITION FOR REDUCTION OF FUEL CONSUMPTION IN INTERNAL COMBUSTION ENGINES

[75] Inventors: John W. Schick, Cherry Hill; Joan M. Kaminski, Clementon, both of N.J.

[73] Assignee: Mobil Oil Corporation, New York, N.Y.

[21] Appl. No.: 941,498

[22] Filed: Sep. 11, 1978

[51] Int. Cl.[3] ..... C10M 1/26

[52] U.S. Cl. ..... 252/56 R

[58] Field of Search ..... 252/56 R

[56] References Cited

U.S. PATENT DOCUMENTS

| | | | |
|---|---|---|---|
| 2,204,601 | 6/1940 | Kavanagh et al. | 252/56 R |
| 2,370,299 | 2/1945 | Farrington | 252/56 R |
| 2,564,423 | 8/1951 | Barnum | 252/56 R X |
| 2,580,036 | 12/1951 | Matuszak et al. | 252/56 R X |
| 2,788,326 | 4/1957 | Bondi et al. | 252/56 R |
| 2,911,367 | 11/1959 | Baus et al. | 252/32.7 E |
| 3,235,498 | 2/1966 | Waldmann | 252/56 R |
| 3,933,659 | 1/1976 | Lyle et al. | 252/32.7 E |

*Primary Examiner*—Delbert E. Gantz
*Assistant Examiner*—Helane Maull
*Attorney, Agent, or Firm*—Charles A. Huggett; Michael G. Gilman; James D. Tierney

[57] ABSTRACT

Lubricating oils containing certain hydroxyl-containing acid esters have been found to be effective friction modifiers and to aid in the reduction of fuel consumption in internal combustion engines.

20 Claims, No Drawings

LUBRICANT COMPOSITION FOR REDUCTION OF FUEL CONSUMPTION IN INTERNAL COMBUSTION ENGINES

BACKGROUND OF THE INVENTION

1. Field of the Invention

The invention relates to lubricating oil compositions. It more particularly relates to lubricating oil compositions that have the ability not only to lubricate an engine, but also to reduce the amount of fuel consumed by such engine. Even more particularly it relates to lubricants containing a small amount of a hydroxyl-containing acid ester.

2. Discussion of the Prior Art

For several years there have been numerous efforts to reduce the amount of fuel consumed by automobile engines and the like. The search for ways to do this was given added impetus by the oil embargo. Many of the solutions have been strictly mechanical, as for example, setting the engine for a leaner burn or simply building smaller cars and smaller engines.

Other efforts have revolved around finding lubricants that reduce the overall friction in the engine, thus allowing a reduction in energy requirements thereto. A considerable amount of work has been done with mineral lubricating oils and greases, modifying them with additives to enhance their friction properties. On the other hand, new lubricants have been synthesized and compounded for use in modern engines. Among these is Mobil 1, a synthetic hydrocarbon fluid and synthetic ester blend, which is known to reduce fuel consumption by a significant amount. With respect to the present Mobil 1 formulation, it is, however, the physical properties of the oil itself that provide improved lubricating (and thus improved fuel consumption) and not the additives therein.

So far as is known, no effort has been made to employ single hydroxyl-containing acid esters at the concentrations necessary for the present invention. U.S. Pat. No. 2,788,326 discloses some of the esters suitable for the present invention, e.g. glycerol monooleate, as components of lubricating oil compositions. However, in each case they are in conjunction with other similar esters. It should be noted that 1% glycerol monooleate gave little advantage as shown in the table in column 7. U.S. Pat. No. 3,235,498 discloses, among others, the same ester as just mentioned. But the patent teaches the use of 0.001 to 1.0% of such esters. Such low percentages do not operate to give the advantages of the present invention.

SUMMARY OF THE INVENTION

In accordance with the invention, there is provided a lubricating oil composition and an amount sufficient to provide fuel reduction in an internal combustion engine, i.e. from greater than about 1.0% to about 4.0% by weight, preferably about 2% to about 4%, of a hydroxyl-containing acid ester selected from glycerol mono- and dioleate, sorbitan monooleate, sorbitan monolaurate, diisostearyl malate and diisostearyl tartrate.

The invention also relates to a method of reducing fuel comsumption by lubricating the internal combustion engine with the said lubricating oil composition.

DESCRIPTION OF SPECIFIC EMBODIMENTS

It has been estimated that a modern car weighing about 4300 pounds with a 10:1 compression ratio and travelling at 40 mph on a level roadway has available for propelling it only 13.1% of the energy available in the gasoline burned. The losses are due primarily to fuel pumping, tare, friction, transmission, rear axle, tires, and wind resistance. The actual fuel used in propelling the vehicle amounted to 16.7 mpg. If all fuel were used in propelling the vehicle, it could travel 128 miles on a gallon of gasoline.

Of the energy loss, approximately 5%, or 6.4 mpg, can be accounted for in loss due to lubricated engine components. Consequently, a mere 10% decrease in boundary and viscous friction would lead to a 3.8% increase in fuel economy (from 16.7 mpg to 17.3 mpg). It is little wonder, then, that energy companies are concerned with finding new lubricants or new additives that have superior lubricity properties.

As was mentioned hereinabove, one method of boosting fuel economy is to optimize the lubrication of the engine and drive train; that is, minimize friction losses between lubricating moving parts. The benefit of Mobil 1 over, for example, Mobil Super is better than 4%, attained solely by lowering of the *viscous* friction of the engine lubricant. Additional improvements may be realized by modification of the boundary friction of the lubricant.

The invention is accomplished by adding to a lubricating oil from greater than about 1% to 4% by weight of one of the following compounds:

1. $HOCH_2CHOHCH_2OCO(CH_2)_7CH{=}CH(CH_2)_7CH_3$
Glycerol Monooleate

2. $HOCH{-}CH_2OCO(CH_2)_7CH{=}CH(CH_2)_7CH_3$
$\quad\;\; | $
$\quad\;\; CH_2OCO(CH_2)_7CH{=}CH(CH_2)_7CH_3$
Glycerol Dioleate

3.

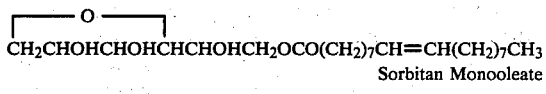

Sorbitan Monooleate

4.

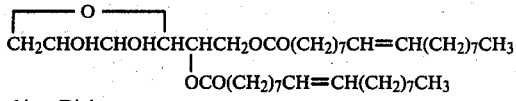

Sorbitan Dioleate

5. $CHOH(CH_2COOC_{17}H_{35})_2$
Diisostearyl Malate

6. $CHOHCOOC_{17}H_{35}$
$\quad | $
$\quad CHOHCOOC_{17}H_{35}$
Diisostearyl Tartrate All these are readily available from commercial sources or are made in accordance with prior art methods by reacting the appropriate acid and glycol or hydroxy-acid and alcohol.

The lubricating oils contemplated for use with the esters herein disclosed include both mineral and synthetic hydrocarbon oils of lubricating viscosity and mixtures thereof with other synthetic oils. The synthetic hydrocarbons oils include long chain alkanes such as cetanes and olefin polymers such as trimers and tetramers of octene and decene. The synthetic oils, which can be used as the sole lubricating oil, with or which can be mixed with the mineral or synthetic hydrocarbon oil include (1) fully esterified ester oils, with no free hydroxyls, such as pentaerythritol esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from 1 to 20 carbon atoms, or mixtures of such acids.

The amount of ester in the lubricant, when present, will usefully range from about 0.5% to about 80%, preferably from about 0.5% to about 30% by weight.

Having described the invention in general terms, the following are offered to specifically illustrate the development. It is to be understood they are illustrations only and that the invention shall not be limited except as limited by the appended claims.

The compounds were evaluated as friction modifiers in accordance with the following test.

LOW VELOCITY FRICTION APPARATUS

Description

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangement.

Procedure

The rubbing surfaces and 12–13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 min. at 250° F., 240 psi, and 40 fpm sliding speed. Afterward, measurements of $U_k$ vs. speed are taken at 240, 300, 400, and 500 psi. Freshly polished steel specimens are used for each run. The surface of the steel is parallel ground to 15 to 20 microinches.

The data obtained is shown in Table 1.

TABLE 1

EFFECT OF FRICTION MODIFIERS - % CHANGE[a]

| Additive | Reference Oils | | | |
|---|---|---|---|---|
| | Synthetic[b] | | Mineral[c] | |
| Speed, SFM | 5 | 30 | 5 | 30 |
| 1. Glycerol Monooleate | | | | |
| 2% | 14.8 | 13.1 | — | — |
| 4% | 18.5 | 18.7 | 11.2 | 14 |
| 2. Glycerol Dioleate | | | | |
| 2% | — | — | 10.2 | 6.3 |
| 4% | 11.4 | 7.6 | 21.4 | 10 |
| 3. Sorbitan Monolaurate | | | | |
| 2% | 5.6 | 11.2 | — | — |
| 4% | 20.4 | 20.3 | 3 | 15 |
| 4. Sorbitan Monooleate | | | | |
| 2% | 1.85 | 0.34 | — | — |
| 4% | 22.2 | 18.3 | 13 | 7 |
| 5. Diisostearyl Malate | | | | |
| 4% | 11.1 | 8.4 | — | — |
| 6. Diisostearyl Tartrate | | | | |
| 4% | 8.5 | 7.56 | — | — |

[a]% Change over reference oil as determined in LVFA test conditions - Temperature 250° F., Load 500 psi

[b]Formulation contains - ca 60% Hydrocarbon polymer, 20% ester fluid (Mobil 1), 20% additives e.g. antioxidant, detergent and dispersant additives.

[c]Formulation contains - ca 85% Solvent Refined Paraffinic Oil and 15% additives e.g. antioxidant, detergent, dispersant and polymeric Viscosity Index Improver. The oil comprised 80% of a 100 second (100° F.) solvent paraffinic neutral mineral oil and 20% of a 325 second (100° F.) solvent paraffinic neutral mineral oil.

Table 2 relates friction reduction of the compounds of the invention to their ability to reduce fuel consumption. The LVFA friction test was run as above, with the conditions of note (b). The table also presents a summary of the fuel economy test, which was run as follows:

FUEL CONSUMPTION TEST

| | |
|---|---|
| Engine Description | |
| 1977 302 CID Ford engine with following characteristics | |
| Bore, in. | 4.0 |
| Stroke, in. | 3.0 |
| Displacement, cu in. | 302 |
| Cylinder Arrangement | V8; 90° |
| Compression Ratio | 8.4:1 |
| Spark Plugs | ARF 52, Gap 0.048–.052 |
| Ignition | Transitorized |
| Carburetor | 2 Bbl. |
| Operating Conditions | |
| RPM | 1200 |
| Coolant Temperature, °F. | 190 ± 2 |
| Test time, Min. | 20 |
| Auxiliary Equipment | |
| Fuel Meter | Fluidyne 1250 |
| Dynamometer | GE 400 HP at 6000 RPM |
| Oil Change/ Supply System | 5 gal. tanks |

Test Procedure

The engine oil sump and oil change/supply system are connected through three-way valves. Once the engine is in operation, lubricants, whether reference or experimental, can be exchanged without engine shutdown.

Prior to testing an experimental lubricant, the engine was brought to its operating conditions with the reference oil (e.g. Mobil Super or Mobil 1 without the additive of this invention), the engine RPM was set at 1200 and series of fuel consumption runs made until repeatable values were obtained. The reference lubricant was exchanged for the experimental lubricant. Any changes in engine operating conditions were adjusted. For example, with friction modified oils, the RPM's actually increase somewhat above the standard 1200 setting indicating a freer movement of engine parts due to less friction. Before any fuel consumption measurements were made, the carburetor setting was manually adjusted to reduce the RMP level back to the standard 1200. Once stabilized, the full meter was activated and the fuel consumption was less.

The percent fuel economy was calculated after correction for temperature-fuel density changes as follows:

$$\% \text{ Fuel Economy} = \frac{\text{Fuel Consumption (Reference)} - \text{Fuel Consumption (Experimental)}}{\text{Fuel Consumption (Reference)}} \times 100$$

TABLE 2

| Additive[a] | LVFA[b] Friction Reduction, % | V-8 Engine, Fuel Benefit, % |
|---|---|---|
| Glycerol Monooleate, % | | |
| 4 | 22 | 1.0 |
| 3 | — | 0.4 |
| 2 | 17 | 0.2 |
| 1 | 13 | 0 |

[a]Additive formulated into a reference oil (Mobil 1).
[b]Oil temperature - 250° F.; Rotational Speed - 30 ft./min., Load - 500 psi.

We claim:

1. A lubricating oil composition containing an additive amount, sufficient to provide fuel consumption reduction in an internal combustion engine, of a member selected from the group consisting of glycerol mono- and dioleate, sorbitan monooleate, sorbitan monolaurate, diisostearyl malate and diisostearyl tartrate.

2. The composition of claim 1 wherein the lubricating oil is a mineral lubricating oil.

3. The composition of claim 1 wherein the lubricating oil is a synthetic ester lubricating oil.

4. The composition of claim 1 wherein the hydroxyl-containing acid ester is present from greater than about 1.0% to about 4% by weight of said composition.

5. The composition of claim 1 wherein the hydroxyl-containing acid ester is glycerol monooleate.

6. The composition of claim 1 wherein the hydroxyl-containing acid ester is glycerol dioleate.

7. The composition of claim 1 wherein the hydroxyl-containing acid ester is sorbitan monooleate.

8. The composition of claim 1 wherein the hydroxyl-containing acid ester is sorbitan monolaurate.

9. The composition of claim 1 wherein the hydroxyl-containing acid ester is diisostearyl malate.

10. The composition of claim 1 wherein the hydroxyl-containing acid ester is diisostearyl tartrate.

11. A method of reducing fuel consumption in an internal combustion engine by lubricating the internal portion thereof with a lubricating oil composition containing an additive amount, sufficient to provide fuel consumption reduction in an internal combustion engine, of a member selected from the group consisting of glycerol mono- and dioleate, sorbitan monooleate, sorbitan monolaurate, diisostearyl malate and diisostearyl tartrate.

12. The method of claim 11 wherein the lubricating oil is a mineral lubricating oil.

13. The method of claim 11 wherein the lubricating oil is a synthetic ester lubricating oil.

14. The method of claim 11 wherein the hydroxyl-containing acid ester is present from greater than about 1.0% to about 4.0% by weight of said composition.

15. The method of claim 11 wherein the hydroxyl-containing acid ester is glycerol monooleate.

16. The method of claim 11 wherein the hydroxyl-containing acid ester is glycerol dioleate.

17. The method of claim 11 wherein the hydroxyl-containing acid ester is sorbitan monooleate.

18. The method of claim 11 wherein the hydroxyl-containing acid ester is sorbitan monolaurate.

19. The method of claim 11 wherein the hydroxyl-containing acid ester is diisostearyl malate.

20. The method of claim 11 wherein the hydroxyl-containing acid ester is diisostearyl tartrate.

* * * * *